US011660869B2

(12) United States Patent
Sato

(10) Patent No.: US 11,660,869 B2
(45) Date of Patent: May 30, 2023

(54) LIQUID EJECTING APPARATUS AND LIQUID EJECTING METHOD

(71) Applicant: Seiko Epson Corporation, Toyko (JP)

(72) Inventor: Hironori Sato, Matsumoto (JP)

(73) Assignee: Seiko Epson Corporation

( * ) Notice: Subject to any disclaimer, the term of this patent is extended or adjusted under 35 U.S.C. 154(b) by 56 days.

(21) Appl. No.: 17/238,334

(22) Filed: Apr. 23, 2021

(65) Prior Publication Data

US 2021/0331476 A1 Oct. 28, 2021

(30) Foreign Application Priority Data

Apr. 24, 2020 (JP) ..... JP2020-077194

(51) Int. Cl.
*B41J 2/165* (2006.01)

(52) U.S. Cl.
CPC ..... *B41J 2/1652* (2013.01)

(58) Field of Classification Search
CPC ..... B41J 2/1652
See application file for complete search history.

(56) References Cited

U.S. PATENT DOCUMENTS 10,737,495 B2 * 8/2020 Nakagawa ..... B41J 2/16526
2019/0248142 A1 8/2019 Nakagawa et al.

FOREIGN PATENT DOCUMENTS

JP 2005-238780 A 9/2005
JP 4168572 B2 * 10/2008 ..... B41J 11/003
JP 2019-136956 A 8/2019

* cited by examiner

*Primary Examiner* — Sharon Polk
(74) *Attorney, Agent, or Firm* — Harness, Dickey & Pierce, P.L.C.

(57) ABSTRACT

A liquid ejecting apparatus includes a liquid ejecting unit, an acquisition unit, and a controller. The liquid ejecting unit includes a nozzle through which a liquid is to be discharged and an ejection surface on which the nozzle opens. The acquisition unit obtains distance information that indicates a distance between the ejection surface and a surface of a medium on which the liquid discharged through the nozzle is to land. The controller varies a flushing amount in accordance with the distance information obtained, the flushing amount being an amount of the liquid discharged during a flushing operation in which the liquid ejecting unit discharges the liquid through the nozzle as a maintenance operation.

9 Claims, 5 Drawing Sheets

| FLASHING INTERVAL [sec] | MEDIUM DISTANCE [mm] | | | |
|---|---|---|---|---|
| | 3.5 | 4.5 | 5.5 | 6.5 |
| 2.8 | 36.9 | 68.5 | 100.0 | 131.6 |
| 5.4 | 65.0 | 96.6 | 128.1 | 159.7 |
| 9.7 | 111.4 | 143.0 | 174.6 | 206.1 |

LANDING DEVIATION AMOUNT [μm]

FIG. 7

| MEDIUM TYPE | MEDIUM DISTANCE MG [mm] |
|---|---|
| FABRIC | 6.5 |
| PHOTO PAPER | 5.5 |
| PLAIN PAPER | 4.5 |
| FILM | 3.5 |

LIQUID EJECTING APPARATUS AND LIQUID EJECTING METHOD

The present application is based on, and claims priority from JP Application Serial Number 2020-077194, filed Apr. 24, 2020, the disclosure of which is hereby incorporated by reference herein in its entirety.

BACKGROUND

1. Technical Field

The present disclosure relates to liquid ejecting apparatuses and liquid ejecting methods.

2. Related Art

As disclosed in JP-A-2005-238780, for example, some liquid ejecting apparatuses discharge viscous ink accumulated inside the nozzles during a print operation. This additional operation is called the flushing operation.

To perform a quality print operation, it is preferable to constantly discharge a large amount of liquid in the flushing operation, independently of the distance between the ejection surface of a liquid ejecting head and the surface of a medium; this distance depends on the type of the medium. However, performing the flushing operation in this manner may decelerate the print process.

SUMMARY

According to a first aspect of the present disclosure, there is provided a liquid ejecting apparatus. This liquid ejecting apparatus includes: a liquid ejecting unit that includes a nozzle through which a liquid is to be discharged and an ejection surface on which the nozzle opens; an acquisition unit that obtains distance information indicating a distance between the ejection surface and a surface of a medium on which the liquid discharged through the nozzle is to land; and a controller that varies a flushing amount in accordance with the distance information obtained, the flushing amount being an amount of the liquid discharged during a flushing operation in which the liquid ejecting unit discharges the liquid through the nozzle as a maintenance operation.

According to a second aspect of the present disclosure, there is provided a liquid ejecting method performed by a liquid ejecting apparatus that includes a liquid ejecting unit. This liquid ejecting unit includes a nozzle through which a liquid is to be discharged and an ejection surface on which the nozzle opens. The above method includes: obtaining distance information indicating a distance between the ejection surface and a surface of a medium on which the liquid discharged through the nozzle is to land; and varying a flushing amount in accordance with the distance information obtained, the flushing amount being an amount of a liquid discharged during a flushing operation in which the liquid ejecting unit discharges the liquid through the nozzle as a maintenance operation.

BRIEF DESCRIPTION OF THE DRAWINGS

FIG. 7 is a table that lists set values of the medium distance stored in the memory in a second embodiment of the present disclosure.

DESCRIPTION OF EXEMPLARY EMBODIMENTS

A. First Embodiment

Figure 1:
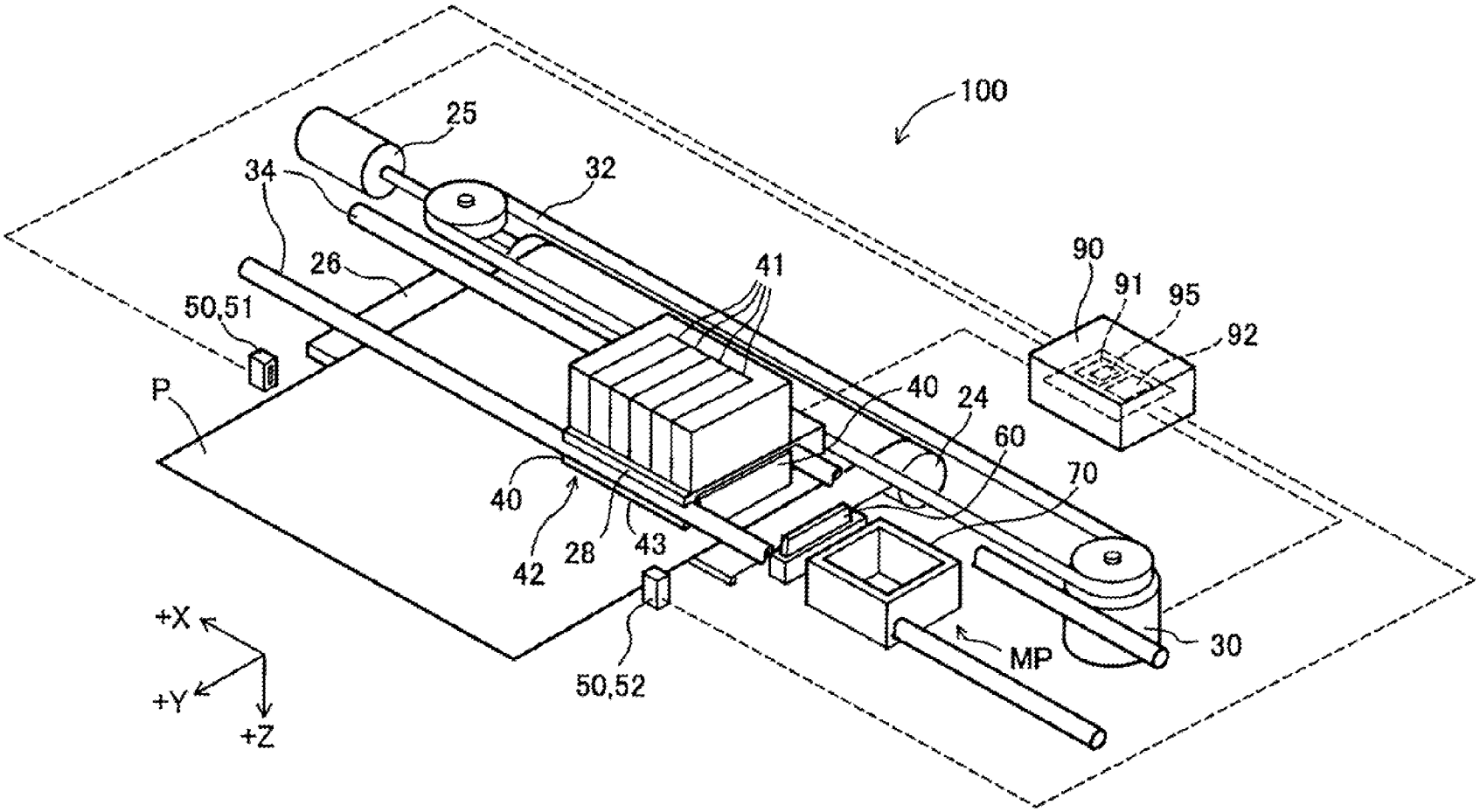
FIG. 1 is a perspective view of a primary configuration of a liquid ejecting apparatus in a first embodiment of the present disclosure.

FIG. 1 is a perspective view of a primary configuration of a liquid ejecting apparatus 100 in a first embodiment of the present disclosure. The liquid ejecting apparatus 100, which may be implemented by an ink jet printer in this embodiment, includes a feed roller 24, a feed motor 25, a platen 26, a carriage 28, a carriage motor 30, an endless belt 32, guide rails 34, a liquid ejecting unit 40, and a controller 90.

FIG. 1 illustrates the +X, +Y, and +Z arrows, which are orthogonal to one another. The Z directions include the +Z direction indicated by the +Z arrow which corresponds to the lower direction in the vertical, and the −Z direction opposite to the +Z direction which corresponds to the upper direction in the vertical. Sometimes, the +Z direction is referred to simply as "downward", whereas the −Z direction is referred to simply as "upward". The X directions include the +X direction indicated the +X arrow and the −X direction opposite to the +X direction. The carriage 28 moves in the X directions. The +X direction corresponds to the left direction of the liquid ejecting apparatus 100 as viewed from the direction opposite to that in which a medium P is to be ejected, whereas the −x direction corresponds to the right direction opposite to the +x direction. The ±X directions are sometimes referred to as the main-scanning directions. The Y directions include the +Y direction indicated by the +Y arrow and the −Y direction opposite to +Y direction. The medium P is transported in the Y directions. The +Y direction corresponds to a direction in which the medium P is to be ejected. The ±Y directions are sometimes referred to as the sub-scanning directions.

The carriage 28 has an upper surface to which a plurality of ink containers 41 are detachably attached; each of the ink containers 41 contains an ink as an example of a liquid. Although the carriage 28 may have four ink containers 41 that contain black, cyan, magenta, and yellow inks in this embodiment, the number of ink containers 41 is not limited. Each ink container 41 may also be referred to as the ink cartridge or tank.

The carriage 28 has a lower surface on which a liquid ejecting unit 40 is mounted. The liquid ejecting unit 40 includes: nozzles 42 through which the liquid is to be discharged; and an ejection surface 43 on which the nozzles 42 open in the +Z direction. The liquid ejecting unit 40 may also be referred to as the liquid ejecting head or print head. The liquid ejecting unit 40 discharges the inks onto the medium P placed on the platen 26 in droplet form. The liquid ejecting unit 40 further includes: passages therein through which the inks are to flow from the ink containers 41 into the nozzles 42; and actuators disposed at predetermined positions inside the passages to discharge the inks from the ink containers 41 to the outside through the nozzles 42. Each of the actuators may include a piezo element and a heater.

The carriage 28 is disposed on the endless belt 32 to be driven by the carriage motor 30. The carriage 28 is moved in the ±X directions along the guide rails 34 extending in the +X direction by the endless belt 32 driven by the carriage motor 30. When the carriage 28 moves, the ink containers 41 and the liquid ejecting unit 40 also move together. While the carriage 28 is moving in the +X or −X direction across the width of the medium P, the liquid ejecting unit 40 performs a print operation on the medium P. This operation is referred to as a one-pass or one-main-scan.

The feed roller 24 transports the medium P in the ±Y directions over the platen 26 by being driven by the feed motor 25. In this embodiment, the medium P may be any given type of medium, examples of which include paper sheets, fabric sheets, and resin films.

The liquid ejecting apparatus 100 has a maintenance position MP adjacent to the side of the platen 26 in the −X direction. Disposed at the maintenance position MP are a wiper 60 and a waste ink container 70 in order to maintain the liquid ejecting unit 40.

The wiper 60, which is disposed between the platen 26 and the waste ink container 70 in the +X direction, has a rubber blade extending upward. The wiper 60 removes contaminants from the ejection surface 43 of the liquid ejecting unit 40 when the carriage 28 moves over the wiper 60 along the endless belt 32. It should be noted that the wiper 60 is an optional component in the liquid ejecting apparatus 100.

The waste ink container 70 receives inks discharged from the liquid ejecting unit 40 during the flushing operation. The waste ink container 70 may have an ink absorber, such as a sponge, therein. Herein, the flushing operation refers to an operation of maintaining the liquid ejecting unit 40, which is performed separately from the print operation on the medium P. During the flushing operation, the liquid ejecting unit 40 continuously discharges the inks to a region outside the print area for the medium P, thereby suppressing an occurrence of a failure to discharge the inks due to viscous ink accumulated inside the nozzles 42 and the liquid ejecting unit 40. The liquid ejecting unit 40 preferably performs the flushing operation only at the maintenance position MP apart from the platen 26 in terms of the print quality, although it can perform the flushing operation near the medium P or the platen 26.

The controller 90, which may be implemented by a computer, includes a central processing unit (CPU) 91 and a memory 92 such as random-access memory (RAM) or read-only memory (ROM). The CPU 91 executes programs stored in the memory 92, causing the controller 90 to perform a print process on the medium P by controlling the feed motor 25, the carriage motor 30, and the liquid ejecting unit 40. In this embodiment, the controller 90 repeatedly performs print operations on the medium P and flushing operations on the waste ink container 70 throughout the print process.

The CPU 91 can also cause the controller 90 to act as an acquisition unit 95 by executing a certain program stored in the memory 92. The acquisition unit 95 obtains distance information, which is information that indicates the distance between the ejection surface 43 and the surface of the medium P on which the inks discharged through the nozzles 42 are to land. Hereinafter, the distance between the ejection surface 43 and the surface of the medium P is referred to as a medium distance MG. In this embodiment, the acquisition unit 95 obtains the distance information by measuring the medium distance MG with detector 50.

In this embodiment, the detector 50, which may be implemented by a transmissive type of displacement sensor, include: a light-emitting section 51 that generates a laser light beam widened in the +Z direction and emits this laser light beam to the medium P in the +X direction; and a light detecting section 52 that receives the laser light beam from the light-emitting section 51. The light-emitting section 51 and the light detecting section 52 are arranged such that the medium P is movable therebetween. The detector 50 detects a thickness T of the medium P based on the amount of the light beam detected by the light detecting section. The light beam detected by the light detecting section is light that has been not blocked by the medium P in the light beam emitted from the light-emitting section 51.

Figures 2, 3:
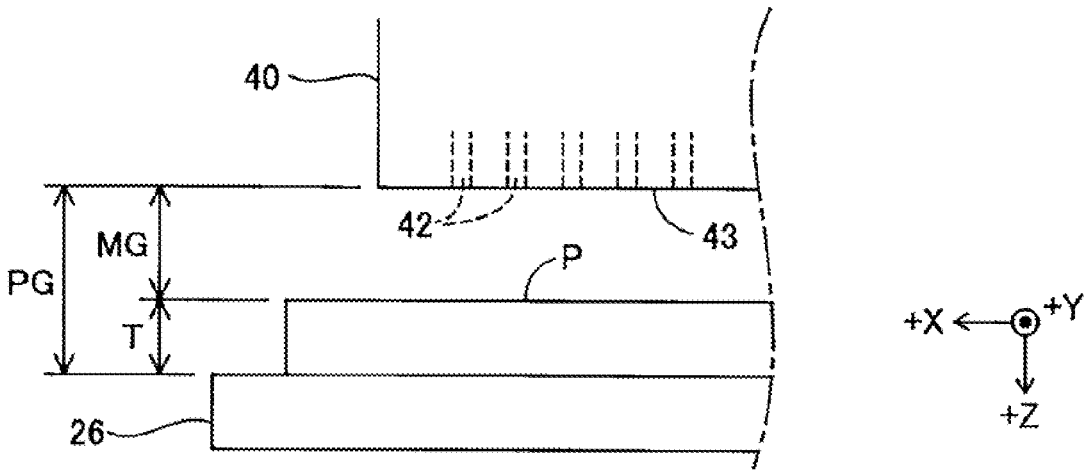
FIG. 2 illustrates a medium distance, which is the distance between the medium and the ejection surface of the liquid ejecting unit.
FIG. 3 is a table that lists measurements of a landing deviation amount.

FIG. 2 illustrates the medium distance MG, which is calculated by subtracting the thickness T of the medium P measured with the detector 50 from a distance PG between the ejection surface 43 and the platen 26. The distance PG may be a preset value stored in the memory 92. The acquisition unit 95 obtains information regarding the thickness T of the medium P from the detector 50 and calculates the medium distance MG based on an equation (1) described below:

$$MG=PG-T \quad (1),$$

wherein PG denotes the distance between the ejection surface 43 and the platen 26, and T denotes the thickness of the medium P. In this embodiment, the distance information indicating the medium distance MG may correspond to merely the medium distance MG.

Figure 4:
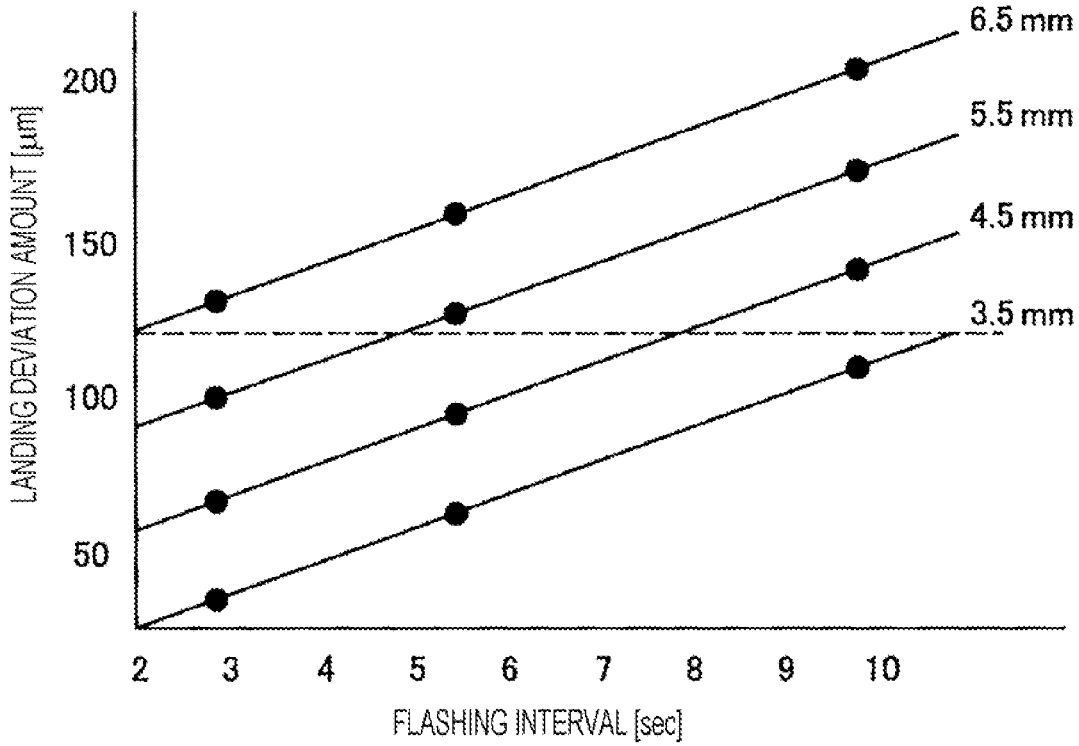
FIG. 4 is a graph on which the measurements in FIG. 3 are plotted.

With reference to FIGS. 3 and 4, a description will be given below of a test of measuring a landing deviation amount in the liquid ejecting apparatus 100. FIG. 3 is a table that lists measurements of the landing deviation amount; FIG. 4 is a graph on which the measurements in FIG. 3 are plotted. Herein, the landing deviation amount may be equivalent to the difference between theoretical and actual positions at which ink lands on the medium P.

In the above test, landing deviation amounts were measured with a varying interval between the flushing operations when the medium distance MG was set to different values, during the print operation performed by the liquid ejecting apparatus 100. More specifically, the interval was set to 2.8, 5.4, and 9.7 sec when the medium distance MG was individually set to 3.5, 4.5, 5.5, and 6.5 mm. Hereinafter, the interval between the flushing operations refers to the flushing interval. In this case, the flushing interval was set to 2.8 sec by the liquid ejecting unit 40 performing one flushing operation for two main-scanning operations. Likewise, the flushing interval was set to 5.4 sec by the liquid ejecting unit 40 performing one flushing operation for four main-scanning operations. The flushing interval was set to 9.7 sec by the liquid ejecting unit 40 performing one flushing operation for eight main-scanning operations. During each flushing operation, the liquid ejecting apparatus 100 discharged a constant total amount of inks. Each landing deviation amount was obtained by measuring the difference between theoretical and actual positions with a micrometer. Each medium distance MG was adjusted by varying the vertical position of the medium P.

As can be seen from FIGS. 3 and 4, the test result reveals that the landing deviation amount increases as the medium distance MG increases and also as the flushing interval increases. In short, the landing deviation amount increases as the total amount of inks discharged during the flushing operation decreases in the print process. In other words, the landing deviation amount decreases as the total amount of inks discharged during the flushing operation increases in the print process. Hereinafter, the total amount of inks discharged during one flushing operation is referred to as the flushing amount.

Figure 5:
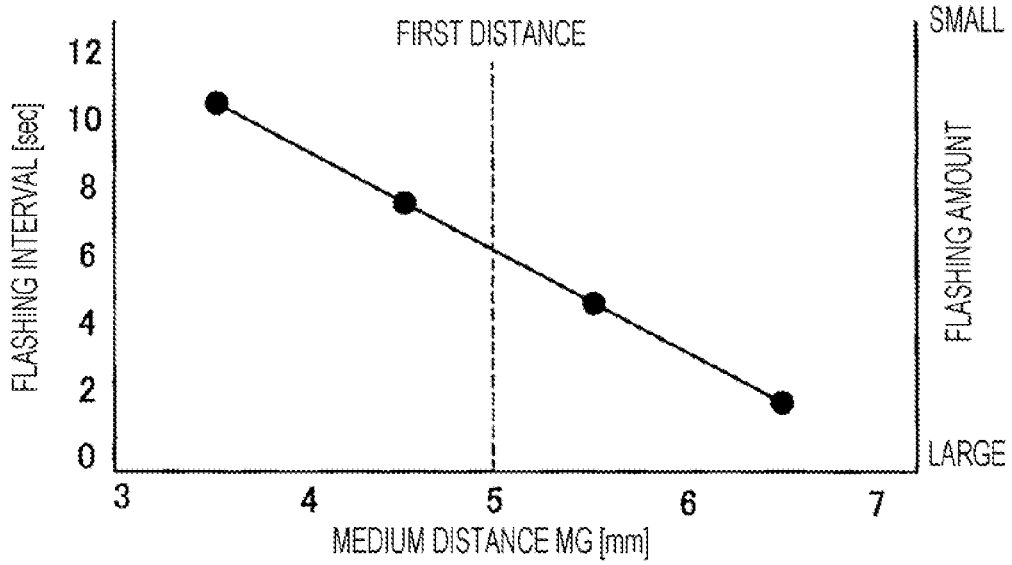
FIG. 5 is a graph showing the relationship between the medium distance and a flushing interval.

FIG. 5 is a graph showing the relationship between the medium distance and the flushing interval. This graph shows the relationship between the medium distance MG and the flushing interval in the case where a target value of the landing deviation amount is 120 μm. In FIG. 4, the target value of the landing deviation amount is indicated by the broken line. The graphs in FIGS. 4 and 5 demonstrate that it is possible to keep the landing deviation amount constant by shortening the flushing interval, namely, by increasing the flushing amount in proportion to an increase in the medium distance MG.

Figure 6:
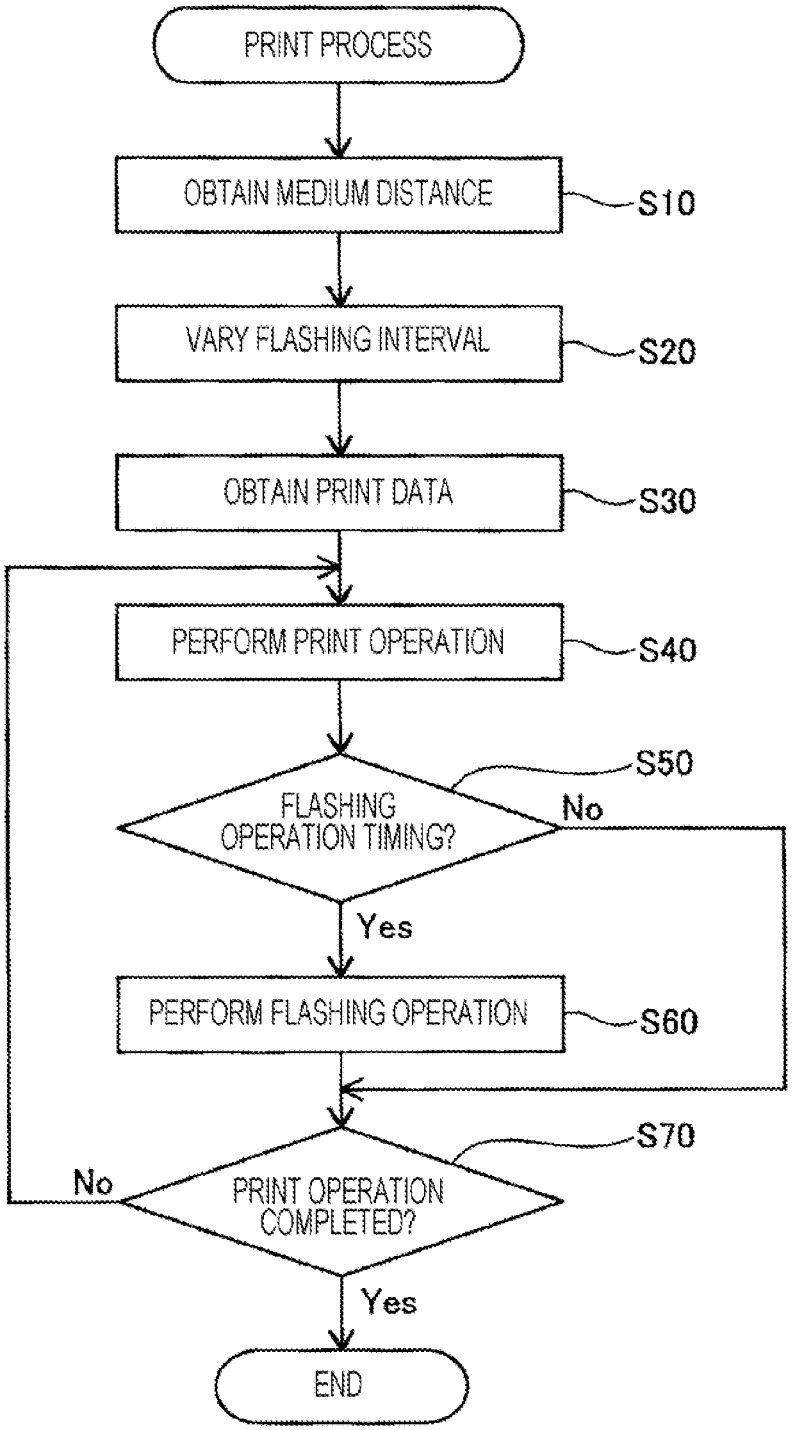
FIG. 6 is a flowchart of a print process performed by the controller in the liquid ejecting apparatus.

FIG. 6 is a flowchart of the print process performed by the controller 90. In response to a user's predetermined operation, the controller 90 starts the print process. In this case, the flushing interval may be set to the shortest value.

After having started the print process, at Step S10, the acquisition unit 95 obtains the medium distance MG. More specifically, the controller 90 drives the feed motor 25 to feed the medium P to the position at which the detector 50 can measure the thickness T of the medium P. Then, the acquisition unit 95 measures the thickness T of the medium P with the detector 50. After that, the acquisition unit 95 calculates and obtains the medium distance MG based on the measurement of the thickness T and the equation (1). After the detector 50 has obtained the thickness T of the medium P, the controller 90 re-drives the feed motor 25 to feed the medium P to the position at which the liquid ejecting unit 40 can perform the print operation on the medium P.

At Step S20, the controller 90 sets the flushing interval in accordance with the medium distance MG that the acquisition unit 95 has obtained at Step S10. More specifically, the controller 90 accesses and refers to the map stored in the memory 92 which indicates the relationship between the medium distance MG and the flushing interval and sets the flushing interval in accordance with the medium distance MG. In this embodiment, as illustrated in FIG. 5, the map specifies the relationship between the medium distance MG and the flushing interval in such a way that the flushing interval is shortened as the medium distance MG increases. The controller 90 varies the flushing interval in accordance with this map, allowing the flushing amount set when the medium distance MG is shorter than a preset first distance (see FIG. 5) to become smaller than that set when the medium distance MG is longer than the first distance. Alternatively, the controller 90 may sets the flushing interval in accordance with a predetermined function instead of the map.

At Step S30, the controller 90 obtains print data. In this case, the controller 90 may obtain the print data, for example, through a computer or memory card coupled to the liquid ejecting apparatus 100.

At Step S40, the controller 90 causes the liquid ejecting unit 40 to perform the print operation on the medium P while driving both the carriage motor 30 and the feed motor 25.

At Step S50, the controller 90 determines whether a current time coincides with a timing at which the flushing operation should be performed, based on the flushing interval that has been set at Step S20. When determining that the current time coincides with the above timing (Yes at Step S50), at Step S60, the controller 90 moves the liquid ejecting unit 40 to the maintenance position MP and then causes the liquid ejecting unit 40 to perform the flushing operation, namely, to discharge predetermined amounts of inks into the waste ink container 70. When determining that the current time does not coincide with the timing (No at Step S50), the controller 90 skips Step S60.

At Step S70, the controller 90 determines whether the print operation according to the print data obtained at Step S30 has been completed. When determining that the print operation has already been completed (Yes at Step S70), the controller 90 terminates this print process. When determining that the print operation has not yet been completed (No at Step S70), the controller 90 returns the print process to Step S40 and performs both the print operation and the flushing operation again.

In the foregoing first embodiment, the liquid ejecting apparatus 100 varies the interval between flushing operations in accordance with the medium distance MG between the ejection surface 43 of the liquid ejecting unit 40 and the surface of the medium P. This can cause the liquid ejecting unit 40 to discharge appropriate amounts of inks in accordance with the medium distance MG during each flushing operation. Consequently, it is possible to suppress the liquid ejecting unit 40 from failing to discharge the inks due to viscous ink accumulated inside the nozzles 42 and the liquid ejecting unit 40. Moreover, it is possible to suppress the print process from decelerating due to flushing operations and the consumptions of inks during each flushing operation from increasing, as opposed to a case where the flushing amount is fixed to a large value in order to reliably ensure the landing deviation amount.

In the foregoing first embodiment, the liquid ejecting apparatus 100 repeatedly performs print operations in which the liquid ejecting unit 40 discharges the inks onto the medium P through the nozzles 42 and flushing operations in which the liquid ejecting unit 40 discharges the inks into the waste ink container 70, throughout the print process. Consequently, it is possible to perform the flushing operations frequently, thereby effectively suppressing an occurrence of a failure to discharge the inks.

In the foregoing first embodiment, the liquid ejecting apparatus 100 varies the flushing amount in such a way that the flushing amount set when the medium distance MG is shorter than the first distance becomes smaller than that set when the medium distance MG is longer than the first distance. Consequently, it is possible to appropriately vary the flushing amount in accordance with the medium distance MG.

In the foregoing first embodiment, the liquid ejecting apparatus 100 varies the flushing amount by changing the interval between flushing operations. Consequently, it is possible to vary the flushing amount per unit time without changing the amounts of inks discharged during each flushing operation. For example, the per unit time refers to the time taken for each print process.

In the foregoing first embodiment, the liquid ejecting apparatus 100 calculates the medium distance MG based on the thickness T of the medium P which has been measured with the detector 50. Consequently, it is possible to set the flushing amount precisely in accordance with the medium distance MG that has been calculated accurately.

In the foregoing first embodiment, the process in which the liquid ejecting apparatus 100 varies the interval between flushing operations in accordance with the medium distance MG does not depend on a print mode. In short, the liquid ejecting apparatus 100 varies the flushing amount independently of the print mode. The print mode, examples of which include a standard mode, a clear mode, a photographing mode, and a draft mode, refers to the print method related to the print quality and speed.

B. Second Embodiment

In the foregoing first embodiment, the acquisition unit 95 measures the thickness T of the medium P with the detector 50 and then calculates the medium distance MG based on the thickness T as the distance information indicating the medium distance MG. In a second embodiment, however, an acquisition unit 95 obtains a set value of a medium distance MG from a memory 92 as distance information. The other configuration of a liquid ejecting apparatus 100 in the second embodiment is substantially the same configuration as that in the foregoing first embodiment. In this case, the liquid ejecting apparatus 100 does not have to include detector 50.

FIG. 7 is a table that lists set values of the medium distance MG stored in the memory 92. In the second embodiment, as illustrated in FIG. 7, the memory 92 stores the set values of the medium distance MG in advance in relation to respective medium types.

When the liquid ejecting apparatus 100 in this embodiment performs the print process in accordance with the flowchart of FIG. 6, at Step S10, a controller 90 receives the type of a medium P selected by a user. In this case, the liquid ejecting apparatus 100 may receive the type of the medium P from the user through an operation button disposed in or a computer coupled to the liquid ejecting apparatus 100. Then, the acquisition unit 95 obtains, from the memory 92, the set value of the medium distance MG which is related to the type of the medium P selected by the user. Based on the set value obtained, at Step S20, the controller 90 varies the flushing interval as in the foregoing first embodiment. The remaining process steps are substantially the same as those in the foregoing first embodiment and thus will not be described below.

As described above, the liquid ejecting apparatus 100 in the second embodiment can easily obtain the medium distance MG without using detector 50 and vary the flushing amount in accordance with the medium distance MG. With this configuration, the liquid ejecting apparatus 100 can be implemented in simple hardware.

Alternatively, instead of setting the medium distance MG based on the type of the medium P selected by the user as in the second embodiment, the liquid ejecting apparatus 100 may ask the user to directly enter the medium distance MG in addition to a print mode, for example, through an operation button provided in or a computer coupled to the liquid ejecting apparatus 100. When receiving the medium distance MG, the controller 90 may store the medium distance MG in the memory 92 and then cause the acquisition unit 95 to obtain the medium distance MG from the memory 92.

C. Modifications (C-1) In the foregoing first and second embodiments, the liquid ejecting apparatus 100 discharges constant amounts of inks during each flushing operation and varies the flushing amount by changing the interval between flushing operations. Alternatively, the liquid ejecting apparatus 100 may perform flushing operations at a constant flushing interval and vary the flushing amount by changing the total amount of inks discharged during each flushing operation. To adjust the total amount of inks discharged during each flushing operation, for example, the controller 90 may vary some parameters: (1) an ejecting time; (2) the number of droplets of inks discharged; and (3) the size of droplets of inks discharged. Consequently, the liquid ejecting apparatus 100 can easily vary the flushing amount by changing the total amount of inks discharged instead of the flushing interval.

(C-2) In the foregoing first and second embodiments, the liquid ejecting apparatus 100 includes the waste ink container 70 disposed adjacent to the side of the platen 26 in the −X direction. Alternatively, the waste ink container 70 may be disposed adjacent to the side of the platen 26 in the +X direction, or two waste ink containers 70 may be disposed adjacent to respective sides of the platen 26 in the ±X directions. If two waste ink containers 70 are disposed adjacent to both the sides of the platen 26, the liquid ejecting apparatus 100 can move the liquid ejecting unit 40 to the waste ink container 70 at the timings when the liquid ejecting unit 40 performs the scanning operation not only in the +X directions but also in the −X direction. This configuration can effectively shorten the time taken for the print process.

(C-3) In the foregoing first and second embodiments, the liquid ejecting apparatus 100 may further include a mechanism for causing the detector 50 to detect the fluff height, floating amount, and height of the medium P and varying the medium distance MG in accordance with these detection results. Examples of the mechanism in the liquid ejecting apparatus 100 include: a mechanism for moving the platen 26 in the ±Z directions; and a mechanism for moving the guide rails 34 in the ±Z directions along which the carriage 28 is supported.

(C-4) In the foregoing first and second embodiments, the liquid ejecting apparatus 100 includes a transmissive type of displacement sensor as the detector 50 that measure the medium distance MG. Alternatively, the detector 50 may be any other type of sensor, such as a contact type of displacement sensor or a sensor having a light-emitting section and a light detecting section integrated with each other. Moreover, although the detector 50 indirectly measure the medium distance MG by measuring the thickness T of the medium P, the detector 50 may directly measure the distance between the ejection surface 43 and the surface of the medium P.

(C-5) In the foregoing first and second embodiments, the controller 90 repeatedly performs print operations and flushing operations throughout a print process. Alternatively, for example, the controller 90 may perform a flushing operation only when starting or terminating the print process.

(C-6) In the foregoing first and second embodiments, the ink containers 41 are mounted on the carriage 28. Alternatively, the ink containers 41 may be mounted inside or outside the liquid ejecting apparatus 100 and supply the inks to the liquid ejecting unit 40 mounted on the carriage 28 through flexible tubes.

(C-7) In the foregoing first and second embodiments, the liquid ejecting unit 40 discharges the inks; however, the liquid ejecting unit 40 may discharge any other type of liquid. Alternatively, the liquid may have only to be a substance of liquid phase, examples of which include less or highly viscous liquid substances, sols, sol waters, other inorganic solvents, organic solvents, solutions, liquid resins, liquid metals, and other liquid materials. Instead of a liquid substance, the liquid may be a solvent in which particles of a solid functional material such as a pigment or metal are dissolved, dispersed, or mixed. Major examples of the liquid include inks and liquid crystals. Inks, such as water-based inks, oil-based inks, gel inks, and hot-melt inks, may contain a liquid composition.

D. Other Modifications

The present disclosure is not limited to the foregoing embodiments and may be implemented in various aspects within its spirit. For example, the present disclosure may be implemented in the aspects that will be described below. The technical features in the foregoing embodiments which are equivalent to those in the aspects can be replaced with others or combined together as appropriate in order to address some or all of the disadvantages of the present disclosure or accomplish some or all the effects of the present disclosure. The technical features in the foregoing embodiments may be deleted as appropriate if they are not described as being essential herein.

(1) According to a first aspect of the present disclosure, a liquid ejecting apparatus includes a liquid ejecting unit, an acquisition unit, and a controller. The liquid ejecting unit includes a nozzle through which a liquid is to be discharged and an ejection surface on which the nozzle opens. The acquisition unit obtains distance information that indicates a distance between the ejection surface and a surface of a medium on which the liquid discharged through the nozzle is to land. The controller varies a flushing amount in accordance with the distance information obtained, the flushing amount being an amount of the liquid discharged during a flushing operation in which the liquid ejecting unit discharges the liquid through the nozzle as a maintenance operation.

A liquid ejecting apparatus of the above first aspect varies an amount of a liquid discharged during a flushing operation in accordance with a distance between an ejection surface of a liquid ejecting unit and a surface of a medium. This configuration can suppress a print process from decelerating due to the flushing operation with a minimal risk of an occurrence of a failure to discharge the liquid and also can decrease the consumption of the liquid during the flushing operation.

(2) In the above liquid ejecting apparatus, the controller may repeatedly perform a print operation in which the liquid ejecting unit discharges the liquid onto the medium through the nozzle and the flushing operation during a print process on the medium. This configuration performs the flushing operation frequently, thereby effectively suppressing an occurrence of a failure to discharge the liquid.

(3) In the above liquid ejecting apparatus, the controller may vary the flushing amount in such a way that the flushing amount set when the distance indicated by the distance information obtained is shorter than a first distance becomes smaller than the flushing amount set when the distance indicated by the distance information obtained is larger than the first distance, the first distance being a preset value. This configuration can vary the flushing amount appropriately in accordance with the distance between the ejection surface and the surface of the medium.

(4) In the above liquid ejecting apparatus, the controller may vary the flushing amount by changing the total amount of liquid discharged during the flushing operation. This configuration can easily vary the flushing amount.

(5) In the above liquid ejecting apparatus, the controller may vary the flushing amount by changing intervals between a plurality of flushing operations. This configuration can vary the flushing amount per unit time without changing the amount of the liquid discharged during each of the flushing operations.

(6) In the above liquid ejecting apparatus, the acquisition unit may obtain a set value of the distance information from a memory. This configuration can easily obtain the distance information.

(7) In the liquid ejecting apparatus, the acquisition unit may obtain the distance information from a detector, the detector being configured to detect the distance between the ejection surface and the surface of the medium. This configuration can accurately detect the distance between the ejection surface and the surface of the medium, thereby varying the flushing amount precisely.

(8) According to a second aspect of the present disclosure, a liquid ejecting method, which is performed by a liquid ejecting apparatus that includes a nozzle through which a liquid is to be discharged and an ejection surface on which the nozzle opens, includes: obtaining distance information indicating a distance between the ejection surface and a surface of a medium on which the liquid discharged through the nozzle is to land; and varying a flushing amount in accordance with the distance information obtained, the flushing amount being an amount of a liquid discharged during a flushing operation in which the liquid ejecting unit discharges the liquid through the nozzle as a maintenance operation.

What is claimed is:

1. A liquid ejecting apparatus comprising:

a liquid ejecting head that includes a nozzle through which a liquid is discharged and an ejection surface on which the nozzle opens; and a processor configured to execute a program so as to:

obtain distance information indicating a distance between the ejection surface and a surface of a medium on which the liquid discharged through the nozzle lands;

set an interval at which the liquid ejecting head discharges the liquid through the nozzle in every flushing operation of repeated flushing operations;

determine whether the repeated flushing operations are required; and perform the repeated flushing operations at the set interval when the processor determines that the repeated flushing operations are required, wherein the processor is configured to set the interval to a first interval when the distance information corresponds to a first distance, the processor is configured to set the interval to a second interval when the distance information corresponds to a second distance, the first distance is longer than the second distance, and the first interval is shorter than the second interval.

2. The liquid ejecting apparatus according to claim 1, wherein the processor is configured to perform a print process, and the print process includes a print operation and the flushing operation, the processor is configured to cause the liquid ejecting head to discharge the liquid via the nozzle on the surface of the medium as the print operation, and the processor is configured to repeatedly perform the print operation and the flushing operation during the print process.

3. The liquid ejecting apparatus according to claim 1, wherein the processor is configured to cause the liquid ejecting head to discharge a reference flushing amount of the liquid in the every flushing operation, the processor is configured to perform the repeated flushing operations at the first interval to discharge a first total flushing amount of the liquid from the nozzle in total during a reference period of time, the processor is configured to perform the repeated flushing operations at the second interval to discharge a second total flushing amount of the liquid from the nozzle in total during the reference period of time, and the first total flushing amount is larger than the second total flushing amount.

4. The liquid ejecting apparatus according to claim 1, wherein the processor is configured to perform the repeated flushing operations at the first interval to repeatedly discharge a first single flushing amount of the liquid from the nozzle per the every flushing operation, the processor is configured to perform the repeated flushing operations at the second interval to repeatedly discharge a second single flushing amount of the liquid from the nozzle per the every flushing operation, and the first single flushing amount is larger than the second single flushing amount.

5. The liquid ejecting apparatus according to claim 1, further comprising:

a memory configured to store the program and a plurality of set values relating to the distance information depending on types of the medium, wherein the processor is configured to obtain a corresponding one of the plurality of set values based on the type of the medium as the distance information from the memory.

6. The liquid ejecting apparatus according to claim 1, further comprising:

a sensor configured to detect the distance between the ejection surface and the surface of the medium so as to generate the distance information.

7. A liquid ejecting method for performing a maintenance operation of a liquid ejecting apparatus, the liquid ejecting apparatus including a liquid ejecting head that includes a nozzle through which a liquid is discharged and an ejection surface on which the nozzle opens, the liquid ejecting method for causing a processor to execute a process, the liquid ejecting method comprising executing on the processor the steps of:

obtaining distance information indicating a distance between the ejection surface and a surface of a medium on which the liquid discharged through the nozzle lands;

setting an interval at which the liquid ejecting head discharges the liquid through the nozzle in every flushing operation of repeated flushing operations;

determining whether the repeated flushing operations are required; and performing the repeated flushing operations at the set interval when the processor determines that the repeated flushing operations are required, wherein the processor is configured to set the interval to a first interval when the distance information corresponds to a first distance, the processor is configured to set the interval to a second interval when the distance information corresponds to a second distance, the first distance is longer than the second distance, and the first interval is shorter than the second interval.

8. A liquid ejecting apparatus comprising:

a liquid ejecting head that includes a nozzle through which a liquid is discharged and an ejection surface on which the nozzle opens; and a processor configured to execute a program so as to:

obtain distance information indicating a distance between the ejection surface and a surface of a medium on which the liquid discharged through the nozzle lands;

set a flushing amount of the liquid that the liquid ejecting head discharges from the nozzle in every flushing operation of repeated flushing operations;

determine whether the repeated flushing operations are required; and perform the repeated flushing operations in which the liquid ejecting head discharges the set flushing amount from the nozzle in every flushing operation when the processor determines that the repeated flushing operations are required, wherein the processor is configured to set the flushing amount to a first flushing amount when the distance information corresponds to a first distance, the processor is configured to set the flushing amount to a second flushing amount when the distance information corresponds to a second distance, the first distance is longer than the second distance, and the first flushing amount is more than the second flushing amount.

9. A liquid ejecting method for performing a maintenance operation of a liquid ejecting apparatus, the liquid ejecting apparatus including a liquid ejecting head that includes a nozzle through which a liquid is discharged and an ejection surface on which the nozzle opens, the liquid ejecting method for causing a processor to execute a process, the liquid ejecting method comprising executing on the processor the steps of:

obtaining distance information indicating a distance between the ejection surface and a surface of a medium on which the liquid discharged through the nozzle lands;

setting a flushing amount of the liquid that the liquid ejecting head discharges from the nozzle in every flushing operation of repeated flushing operations;

determining whether the repeated flushing operations are required; and performing the repeated flushing operations in which the liquid ejecting head discharges the set flushing amount from the nozzle in every flushing operation when the processor determines that the repeated flushing operations are required, wherein the processor is configured to set the flushing amount to a first flushing amount when the distance information corresponds to a first distance, the processor is configured to set the flushing amount to a second flushing amount when the distance information corresponds to a second distance, the first distance is longer than the second distance, and the first flushing amount is more than the second flushing amount.

* * * * *